United States Patent [19]

Tenhunen

[11] Patent Number: 4,766,824

[45] Date of Patent: Aug. 30, 1988

[54] BURNER ESPECIALLY FOR BURNING BIOMASS

[75] Inventor: Erkki Tenhunen, Viitasaari, Finland

[73] Assignees: Sermet Oy; Maamiehen Sähkö Oy, both of Finland

[21] Appl. No.: 933,220

[22] PCT Filed: Feb. 28, 1986

[86] PCT No.: PCT/FI86/00022

§ 371 Date: Oct. 24, 1986

§ 102(e) Date: Oct. 24, 1986

[87] PCT Pub. No.: WO86/05257

PCT Pub. Date: Sep. 12, 1986

[30] Foreign Application Priority Data

Feb. 28, 1985 [FI] Finland ..... 850808

[51] Int. Cl.[4] ..... F23G 5/00; F23G 5/12; F23G 5/44

[52] U.S. Cl. ..... 110/256; 110/281

[58] Field of Search ..... 110/293, 294, 281, 282, 110/256

[56] References Cited

U.S. PATENT DOCUMENTS 480,538 8/1892 Wilkinson ..... 110/282
836,402 11/1906 Politz ..... 110/293
4,325,310 4/1982 Babbage ..... 110/293 X
4,537,140 8/1985 Baker ..... 110/281

FOREIGN PATENT DOCUMENTS 536831 10/1931 Fed. Rep. of Germany ..... 110/294

*Primary Examiner*—Edward G. Favors
*Attorney, Agent, or Firm*—McGlew and Tuttle

[57] ABSTRACT

A burner particularly for burning biomass. The burner comprises a combustion chamber (6) whereinto the fuel is fed, an ash pit (8) which is located below the combustion chamber (6), and an automatic stoker (4) which is connected to the combustion chamber (6) by means of an inlet shaft or equivalent. The burner (1) is a separate unit, which can be attached to a furnace (2). The combustion chamber (6) is formed of a fire shaft (7) comprising an inlet surface (71), a countersurface (72) and a slot (73) located therebetween. The inlet surface (71) and the countersurface (72) are planar surfaces inclined to opposite directions so that they together form a V-shaped fire shaft. The fuel stoker (4) is connected to the combustion chamber (6) by means of the inclined inlet surface (71), which serves as the inlet channel. The stoker (4) is connected to the inclined inlet surface (71) so that it is placed vertically against it and the width(s) of the stoker (4) is roughly equal to the width of the combustion chamber (6).

8 Claims, 2 Drawing Sheets

BURNER ESPECIALLY FOR BURNING BIOMASS

Figure 1:
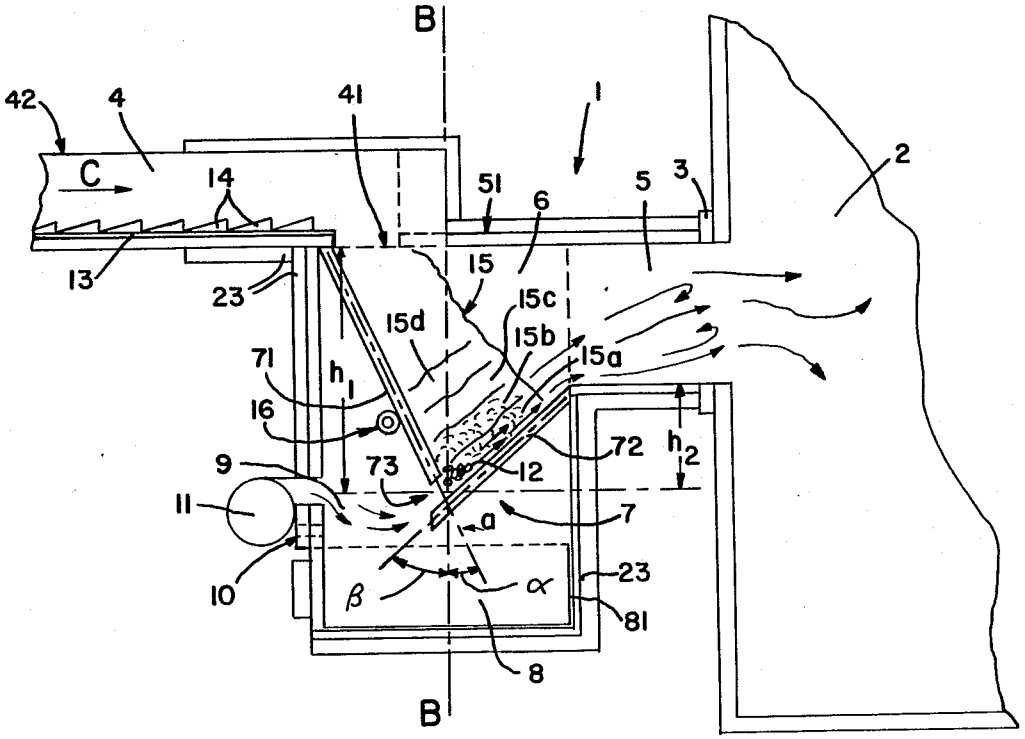

The present invention relates to a burner which is particularly suited for burning biomass such as wood chips and peat, the said burner comprising a combustion chamber whereinto the fuel is fed, an ash pit located below the combustion chamber, and an automatic feeder which is connected to the combustion chamber by means of an inlet shaft or equivalent arrangement. The term 'burner' here refers to a fuel feeding and burning device which is attached to a furnace as an auxiliary arrangement.

In the prior art there are known separate front extension furnaces which can be connected to standard central heating furnaces. The front extension furnace comprises a combustion chamber, a grate and an ash pit. The front furnace is connectable to the furnace proper by means of a fire shaft. A fuel storage hopper is located above the front extension furnace so that between the hopper and the combustion chamber there are arranged locking means which are used for supplying fuel into the combustion chamber. For primary air supply and ash removal, the combustion chamber is provided with a hatch. For secondary air supply, an air inlet pipe is connected to the fire shaft. The fuel is gasified in the front extension furnace, and the resulting gases are burned by means of secondary air in the furnace proper.

The front extension furnaces are devices of the same size as the main furnace, and their purpose is to readjust for example an old oil furnace so that it is suitable for burning sawdust or wood chips. The readjustment operations are cumbersome and the front extension furnace requires a lot of space. This kind of a front extension furnace and main furnace combination has a high draught resistance, and the output regulation of the combustion process and the said combination becomes difficult. The combination is not easily adapted to quick changes in the fuel charge, and it does not function with small charges. Damp wood chips or damp sawdust cannot be used as fuel because the combustion temperature is relatively low, and the fuel supply into the front extension chamber is carried out in comparatively large and uneven batches by means of opening the locking members.

The German Patent Publication Nos. 62 043, 917 741 and 917 742 introduce various furnace constructions resembling the front extension surface and main furnace combinations; in these furnace constructions, the combustion chamber provided for solid fuel, and the afterburning chamber for gases, form a uniform furnace assembly. The combustion chamber is large, and it is provided with vertical and/or inclined grate arrangements. The use of these arrangements aims at achieving a high total output, which again requires that large amounts of fuel are treated at a time. The furnace output cannot be substantially regulated.

The installation of an automatic solid fuel feeder in connection to the aforementioned types of furnace and/or front extension furnace and main furnace combinations is difficult, sometimes outright impossible. If the feeder is managed to be connected to the furnace, the burning effeciency often remains poor because these furnaces and/or front extension furnaces generally have a large grate and a combustion chamber which is too small with respect to the grate. The flame temperature remains too low because the flames get into immediate contact with the cold fire surfaces and are cooled off so that complete combustion is not possible. The feeder input heigth also tends to rise high, particularly in bottom-heated furnaces where the fuel is fed in through the fuel supply hatch. In conventional furnaces the burning of sod peat, milled peat, peat pellets and straw pellets is also difficult owing to the large amount of created ashes and the fact that the ashes are sintered.

Within the class of regular burners which are suited for solid fuels can be included for instance so-called stokers that are primarily meant for burning wood chips, and incineration dishes or shafts which are provided with various fuel feeding means located on the top or on the same level as the dish or shaft itself. The stokers, incineration dishes and shafts are installed within the furnace combustion chamber so that they take up part of the chamber volume. The feeding means are often spiral feeders.

The drawbacks in the aforementioned burners are connected with ash removal, fuel supply and power regulation. Ashes are removed for instance from the combustion chamber of the stoker or from the fire shaft of the burner so that they are pushed off by the fresh fuel fed in by the feeder spiral. The ashes are sintered, i.e. the ashes, while first melting and subsequently cooling off, form a solid substance which sticks onto the walls of the combustion chamber or onto the shaft or the grate. The sintered ashes diminish the combustion space and block the air inlets in the shaft or in the grate. While the operation of the feeder is continued, part of the unburned fuel drops over the edges of the stoker or of the fire shaft down onto the bottom of the furnace, and thus the air supply is obstructed, which causes the combustion process to slow down. This causes the maintenance periods to become fairly short, particularly at times when the fuel charge is at its largest. The output regulation is also difficult with these kind of burners; it is particularly difficult to arrange the apparatus to idle, i.e. to function with minimum power. Moreover, the spiral feeding system is sensitive to disturbances and expensive to manufacture.

The object of the present invention is to achieve an improvement in solid fuel burners and feeders and to realize a burner, the output whereof can be regulated within a wide range and fairly quickly, and which burner needs regular maintenance at remarkably longer intervals than conventional solid fuel burners. The invention is characterized by the novel features enlisted in the appended patent claims.

The aforementioned drawbacks are eliminated in the solid fuel burner of the present invention. The burner forms a separate unit which can be combined to any existing furnace, particularly externally. The burner is installed for example in the bottom hatch of the furnace, so that the feeder input height remains low, preferably between 30–60 cm.

In the burner, the fuel is burned directly and immediately. The inlet surface and the countersurface form a fire shaft whereby ideal conditions are created for the rapid gasification and immediate combustion of the fuel. Fuel is added into the powerfully glowing heap of embers or to the immediate vicinity thereof. Combustion takes place mainly in the vicinity of the countersurface, so that especially damp fuel has time to dry gradually and at least partly before ignition. Experiments have proved that even biomass with a humidity content of approximately 60% can be fed into the combustion chamber, which has not been possible in the prior art furnaces or burners without suffocating the combustion process.

The temperature of the flame is remarkably high, generally between 600°-1300° C. This leads to a high burning efficiency. Inside the furnace itself there is left additional space for proper afterburning brickworks, for instance, so that the combustion process proceeds in a high temperature to the very end. The fuel supply into the combustion chamber is adjusted by means of the automatic stoker connected to the inclined inlet surface, and the amount of combustion air is regulated by means of a blower; consequently the ratio between the fuel and the combustion air is accurately adjusted. All furnaces can be converted into top-heated furnaces operated on the so-called scattering principle. All of the fire surfacs of the furnaces become practically useful, so that the outlet temperature of the combustion gases is decreased and the total efficiency of the furnaces is increased. Idling losses are accordingly diminished, because the fuel addition scattered each time into the combustion chamber of the burner needs only to be sufficient for keeping up the fire.

In the burner of the invention, solid fuels is burned in a process which is in complete control; the total efficiency of the furnace whereto the burner is connected can be adjusted within a very wide range by regulating the fuel supply and the air flow. In conventional furnaces or in furnaces provided with a front extension furnace, this kind of process-scale control is not possible.

In the combustion chamber of the burner there can also be burned materials, for example peat, with a low ash melting point and a high ash content. At least half of the created ashes are now left in the ash pit of the burner. Ash removal from the furnace is much more troublesome than ash removal from the ash pit of the burner. Moreover, the wall surfaces in the furnace combustion chamber remain cleaner than in other burner applications. This is an important argument also when burning biomass other than peat.

Figure 3:
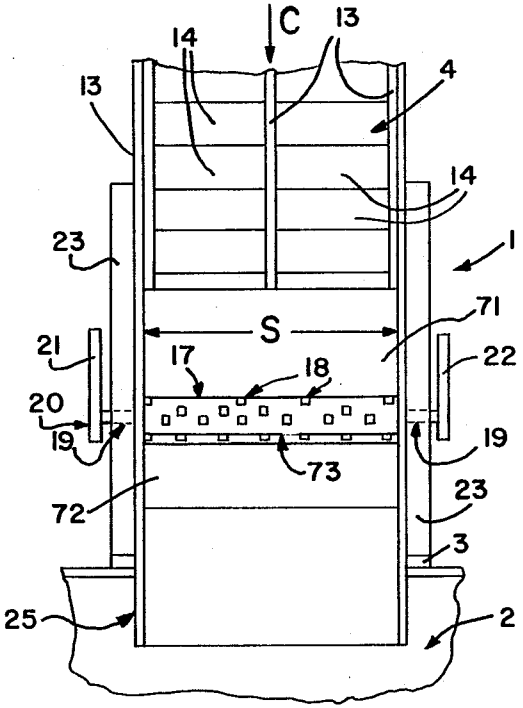
Figure 2:
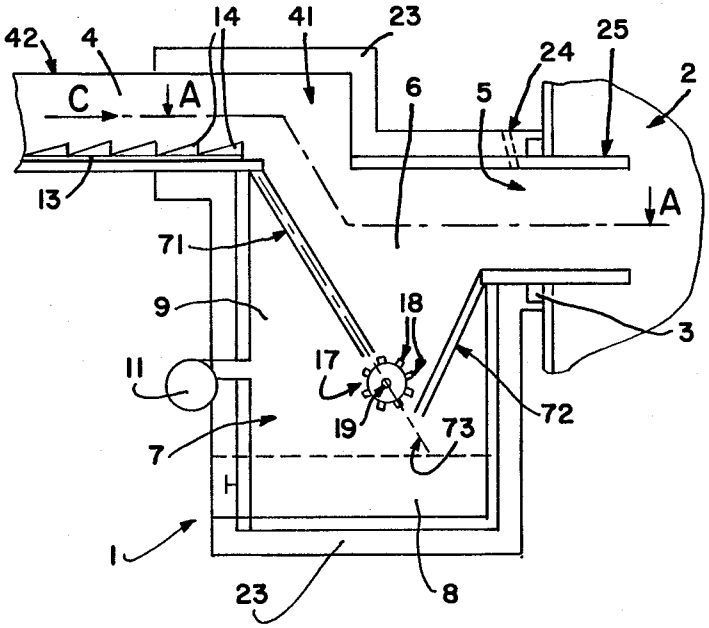

In the following the invention and its additional advantages are described in more detail with reference to the appended drawing, where FIG. 1 illustrates the structure of a burner according to the invention, seen in side-view cross-section;

FIG. 2 illustrates another embodiment of the burner of the invention, also in cross-section; and FIG. 3 illustrates the burner of FIG. 2, shown along the section A—A.

The burner of the invention is a separate unit which can be connected to any furnace or other corresponding furnace construction. In FIGS. 1 and 2, the burner 1 is connected to the furnace 2, preferably to its bottom hatch 3. The connecting can be carried out either directly or by means of a separate channel 5. The fuel bin, which is not illustrated in the drawing, is connected to the burner 1 proper by means of the stoker 4.

The burner 1 comprises the combustion chamber 6, whereinto the fuel is fed, and the ash pit 8, which is located below the combustion chamber. It can be understood that the aforementioned automatic stocker 4 also belongs to the burner. The stoker 4 is connected to the combustion chamber 6 by means of an inlet shaft or the like. The inlet shaft may be a separate, for instance vertical and tubular member, located between the stoker 4 and the combustion chamber 6, but the stoker 4 can, in certain conditions, also be connected directly to the combustion chamber 6 as is shown in FIGS. 1 and 2.

The combustion chamber 6 is formed of the fire shaft 7 which comprises the inlet surface 71, the countersurface 72, and the slot 73 therebetween. The inlet surface 71 and the countersurface 72 are advantageously planar surfaces which are inclined to opposite directions so that between them they form a V-shaped fire shaft. At the bottom and at two sides, this fire shaft 7 defines the combustion chamber 6 of the burner 1. The side walls of the burner 1 form the end walls of the combustion chamber. The fuel stoker 4 is connected to the combustion chamber 6 by means of the inclined inlet surface 71, which thus serves as the inlet shaft or part thereof.

The stoker 4 if formed of one unit, or of several adjacent feeding units. The stoker 4 is connected to the inclined inlet surface 71 so that it is located vertically against it, and simultaneously against the slot 73 and the countersurface 72. The width s of the stoker 4 is roughly equal to that of the inlet surface 71, and thus of the whole combustion chamber 6.

The inclination $\alpha$ of the inlet surface 71, with respect to an imaginable vertical plane B—B, is generally between 15° . . . 45°. The inclination $\beta$of the countersurface 72, with respect to the imaginable vertical plane B—B, but slanted in the opposite direction than the inclination $\alpha$ of the inlet surface 72, is most advantageously between 60° . . . 10°. The inclination $\alpha$ of the inlet surface 71 is defined according to the fuel in question. The fuel must slide properly down along the inlet surface. The inclination $\beta$ of the countersurface 72 is also defined according to the fuel to be used. The general principle is that the more rolling or flowing is the nature of the employed solid fuel, the gentler is the slope of the countersurface 72, i.e. the larger is the angle $\beta$. At its largest the angle $\beta$ may be even 90°. Either the inlet surface 71 or the countersurface 72, or both, can also be somewhat coarsened; this prevents small-grained fuels from rolling too easily through the slot 73 into the ash pit 8.

The bin 9 located below the fire shaft 7 and the ash pit 8 advantageously form together a uniform space. In the ash pit 8 there can be installed an ash box or ash cassette 81, which can be removed from the ash pit 8 and emptied or replaced when necessary. Within the said uniform space, there is arranged an air inlet opening 10, the size whereof can also be adjusted, and which can be closed altogether if desired.

It is advantageous to connect a fan 11 or equivalent to the uniform space located below the fire shaft 7. By means of this fan, in the space 8, 9, below the fire shaft, there is created positive pressure with respect to the combustion chamber 6. When fuel is ignited by employing positive pressure, the draught can be intensified and a successful ignition ensured. Thereafter the combustion air may be supplied via the air inlet 10. As regards the adjusting of the combustion process, particularly in case the employed fuel is biomass with a high humidity content, it is necessary to keep the fan 11 in operation throughout the process.

In the embodiments illustrated in the drawing, the fuel stoker 4 is connected directly to the burner 1. Now the height $h_1$ of the inlet surface 71, measured from the slot 73 to the fuel inlet opening 41, is larger than the height $h_2$ of the countersurface 72, measured from the slot 73 to the outlet of the burner 1 or to the connecting channel 5. the height $h_1$ of the inlet surface 71 is advantageously between 30–70 cm, while the height $h_2$ of the countersurface 72 is $h_2 \approx 0,10 \ldots 0,72 \times h_1$.

If the stoker 4 is connected, by means of a separate tubular inlet channel (not illustrated in the drawing) or equivalent to the fuel inlet 41 and further to the combustion chamber 6 of the burner 1, the height $h_1$ of the inlet surface 71 may be equal to the height $h_2$ of the countersurface 72. This means that the inlet shaft wall on the side of the inlet surface 71 extends downwards after the fuel inlet 41, and joins for instance the inlet surface 71 approximately at the height $h_2$ of the countersurface 72 with respect to the slot 73, or in general somewhere between $h_1 \rightarrow h_2$.

On the cross-section level, the fuel inlet 41 extends horizontally from the top edge or similar point of the inlet surface 71 as far as the slot 73 at the most, i.e. as far as the imaginable vertical plane B—B. Advantageously the fuel inlet 41 is narrower than the plane B—B, as the dotted lines in FIG. 1 show. The top part or the continuation 51 of the channel 5 forms part of the frame construction of the burner 1. The purpose for limiting the width of the fuel inlet 41 is to make sure that the fire cannot extend from the combustion chamber 6 into the fuel located in the stoker 4, and further into the storage bin.

The stoker 4 is placed within a closed channel 42 through which air is not normally conducted to the combustion chamber, or vice versa. For safety reasons, it is further possible to arrange a separate locking device either in the fuel inlet 41 or in the vicinity thereof, which locking device is employed for locking the inlet opening 41 or the inlet channel.

Between the inlet surface 71 and the countersurface 72 there is located the slot 73, as was explained above. Advantageously the said surfaces 71 and 72 are matched so that the imaginable continuation a of the inlet surface 71 intersects the countersurface 72, or matches its bottom edge. This arrangement allows the slot 73 to be more easily adjustable. On the other hand, the fuel grains 12 or the lke that slide along the inlet surface 71 are continuously squeezed, under the pressure of the supplied fresh fuel, against the countersurface 72, and consequently they cannot easily fall unburned into the ash pit 8 through the slot 73. Thus the width of the slot 73 can be larger than the average diameter of the fuel grains.

In principle the stoker 4 connected to the burner 1 proper can be a stoker of any of the conventional types, for example a spiral stoker or an apron conveyor. The essential point is that the stoker can be used for supplying solid fuel, such as wood chips or peat pellets, into the combustion chamber 6 in a continuous, even flow of an adjustable volume and roughly along the width of the inlet 41, the inlet surface 71 and the slot 73. On this condition the burner functions in an ideal fashion.

An advantageous fuel stoker has been introduced for instance in the international patent application PCT/FI84/00059. The stoker 4 illustrated in the drawing represents the said advantageous type. The operation of the fuel stoker 4 is based on the idea that two or more supporting members 13, such as planes, bars or rails, provided with dents or flakes 14, move back and forth so that the adjacent support member 13 always move to opposite directions. The dents or flakes 14 are arranged, with respect to the motional direction of the supporting members 13, in an assymetrical fashion so that the solid fuel located on top of the dents or flakes, which fuel is to be transported and fed in, is more easily shifted in one direction, i.e. in the transport direction C, than in the opposite direction.

Stokers of the above described type can be used for conveying and for feeding even exceptionally non-homogenous and/or extremely light materials. Small dents or flakes in the support members—in accordance with the lump size and lump distribution of the conveyed material—render a surprisingly high material transfer efficiency. By regulating the length of the back and forth movement of the supporting member, the transfer properties of the apparatus can be adjusted to be optimal while the weight, porosity etc. of the treated material change. Power demand, compared to the transfer and/or feeding output, is extremely modest. The apparatus has a simple structure. By employing this apparatus, for instance the feeding of wood chips into the burner is carried out smoothly so that the total efficiency of the heater, for example, is improved. Moreover, the stoker is not easily blocked, and it is well suited for example for very large burners.

The burner of the invention is operated as follows. The fuel stoker 4 is advantageously provided with a regulation means (not illustrated in the drawing) which regulates the scattering of the fuel; the fuel is scattered through the fuel inlet 41 in a continuous flow of a desired volume into the fire shaft 7 and the combustion chamber 6. Thereafter the fuel slides, along the inclined inlet surface 71, towards the slot 73 in a flow roughly as wide as the slot itself. The surfaces 71 and 72 direct the fuel towards the slot 73, in the vicinity whereof the burning takes place first, and always in the case of a small charge. According to the size of the fuel grains 12, the inclinations $\alpha$ and $\beta$ of the inlet surface 71 and the countersurface 72 are matched with each other so that the fuel cannot slide into the ash pit 8 through the slot 73. The angle $\beta$ of the countersurface 72 is so adjusted that the inclination is not so steep that the fuel should slide directly into the slot 73, but on the other hand most advantageously so that the surface 72 is not so near its horizontal position that the fuel could not be directed towards the slot 73 by means of the two surfaces 71 and 72.

While the fan 11 is in operation, positive pressure prevails in the ash pit 8 and in general all over the space 8, 9 below the fire shaft; this positive pressure makes air to flow via the slot 73 and through the fuel layer 15 into the combustion chamber 6 and further towards the furnace 2, thus intensifying the combustion process. This ensures good conditions for a powerful and rapid gasification of the fuel and for an immediate combustion of the gases. In the course of the gasification and combustion process, the fuel grains 12 become smaller and lighter, so that the current of air also prvents them from falling into the ash pit 8 through the slot 73. Along the whole width of the slot 73 there is consequently formed an intensive, centralized combustion area, where fresh fuel is continiously supplied along the inlet surface 71. A countercurrent principle applies in the combustion process: while burning, the solid fuel becomes smaller in volume and is shifted downwards, and the major part thereof finally ends up in the ash pit 8, whereas the gaseous ingredients created in the combustion process are shafted upwards and burn immediately in the combustion chamber 6, in the connecting channel 5 (in case it is used) and in the furnace 2, and develop a remarkably high temperature, which may rise even up to 1000° C.

The power regulation of the burner of the invention can be realized in a more flexible fashion than is the case with a conventional on/off system. Fuel is supplied, by employing the stoker 4, in batches defined by the said stoker, into the combustion chamber 6 located between the inlet surface 71 and the countersurface 72. With low efficiency, the fuel layer is narrow: the combustion takes place near the slot 73 of the combustion chamber 6. The air needed in the combustion process is blown in to the combustion chamber 6 through the slot 73 in a volume flow of a desired size. The electric motor or other actuator of the fan 11 is controlled by means of a suitable adjusting device. While increasing the burner efficiency, the batching speed of the stoker 4 is also increased so that the fuel layer in the combustion chamber 6 grows thicker. Simultaneously the combustion area is enlarged. This widening of the area takes place particularly in the fuel layer 15*a* located near the countersurface 72. Fuel can be added up to the point where the combustion chamber 6 is filled as far as the fuel inlet 41. Thereafter the efficiency can be increased by increasing the blowing efficiency of the fan 11, i.e. by increasing the volume flow of the supplied air.

A limit switch can be installed in the fuel inlet 41. This secures for instance that the stoker 4 does not batch in fresh fuel when the combustion chamber 6 is full. On the other hand, by means of the limit switch the burner can also be operated according to the on/off principle.

FIG. 1 illustrates a situation when a large amount of fuel 15 is located in the combustion chamber 6. Combustion takes place in the first fuel layer 15*a* near the countersurface 72. The adjacent second fuel layer 15*b* is pressed, owing to gravity and the supplied fresh fuel, against the burning layer and is on the verge of igniting. The third fuel layer 15*c* has already reached a high temperature, and the fourth layer 15*d* is rapidly warming up. As a consequence of a process of this kind, the fuel 15 is dried in layers before ignition. Thus the burner can be used for burning damp fuels, even with a humidity content as high as 60%.

Solid fuels, particularly wood chips, are liable to arching, i.e. in this case they tend to form recesses in the fuel 15 located in the combustion chamber 6. This may disturb the shifting downwards of the fuel, and even interrupt it. In order to prevent arching, the inlet surface 71 of the burner, or a part attached to this surface, can be connected to a device which makes it vibrate—i.e. it is set into a slight back and forth motion. As a consequence, the fuel slides down along the inlet surface 71 without disturbances.

Advantageously the vibrating device is realised so that the top edge of the inlet surface 71 is attached flexibly to the frame of the burner 1. Below the inlet surface 71 there is arranged one or more wobblers 16, which are rotated by means of an axis, using a suitable actuator such as an electric motor, either throughout the whole combustion process or every once in a while. While rotating, the wobbler 16 affects the inlet surface 71 and sets it into a slight back and forth motion. In a similar fashion the countersurface 72 can be arranged to move, either alone or together with the inlet surface 71.

The preferred embodiment of the burner of the invention illustrated in FIG. 1 is mainly suited for burners with a low efficiency, i.e. below 20 kW. With high-efficiency burners, it is advantageous that a separate ash remover is installed in the slot 73 between the inlet surface 71 and the countersurface 72. On the other hand, the ash remover is needed in low-efficiency burners as well, if for instance the fuel to be burned is biomass with a high ash content, such as milled peat or sod peat or peat and straw pellets.

The ash remover 17 is advantageously a bar-like member or a hollow tubular member, as is apparent for example from FIGS. 2 and 3. The ash remover 17 is provided with brackets 18, arranged at regular intervals therein. The ash remover 17 extends, parallel to the slot 73, through the fire shaft 7 and the combustion chamber 6. The ash remover 17 can be moved either axially, or transversally back and forth, i.e. it can be either vibrated or rotated around its axis 19, either in one direction or in changing directions. At the end of the axis 19 there is attached for instance a rotor wheel 20, which is connected, by means of belt gearing 21, to an actuator such as an electric motor. The ash remover 17 helps to keep the slot 73 open along the whole width thereof, which ensures an even combustion of the fuel. The brackets 18 provided in the ash remover 17 prevent the ashes from sintering, and improve their crushing.

If the ash remover 17 is formed of a tubular member, it can be provided with effective cooling. The ash remover 17 is connected to a cooling agent source, for instance to an air or liquid supply (water, oil). The pressurized cooling agent circulates inside the tubular ash remover and cools it. With this procedure, the strong heat created in the slot 73 during the combustion process does not wear the ash remover out too quickly, but it is much more durable in use.

The tubular ash remover 17 is advantageously placed on the imaginable continuation a of the inlet surface 71. The slot 73 proper thus remains between the ash remover 17 and the countersurface 72. The size of this slot is defined, in the same fashion as before, according to the type and grain size of the fuel in question.

In order to maintain the temperature in the combustion chamber 6 as high as possible, which is profitable for the combustion process, the burner 1 and its possible connecting channel 5 are provided with a heat insulating layer 23.

In the connecting channel 5 there can be arranged secondary air channels 24, which secure a sufficient air supply particularly for large burners. The connecting channel 5 can be continued to the inside of the furnace 2 in the form of a so-called afterburning channel 25. Th secondary air channels 24 and the afterburning channel 25 maintain the gas combustion temperature high and improve the mixing and complete burning of the gases.

The combustion chamber 6, and particularly the inlet surface 71 and the countersurface 72 of the fire shaft 7, as well as the connecting channel 5, are made of a highly heat-resistant material such as iron, or partly for instance of ceramic materials. All inner parts of the burner 1, and particularly the inlet surface 71 and the countersurface 72, as well as the ash remover 17, can be arranged to be replaceable elements. This is important with respect to the maintenance, because none of the currently known materials can long resist the high temperatures created during the combustion process of the burner.

The efficiency of the burners of the invention is above all defined on the basis of the width s of the fire shaft 7. According to a rough estimate, the burner efficiency may rise up to 0,5 MW when s=50 cm, and up to 1,5 MW when s=150 cm. In the above described burners, the diameter of the tubular ash remover 17 is for instance roughly 10 cm, and that of the slot 73 is for instance 5 cm. The height $h_1$ of the inlet surface 71 is for example 60 cm, when the height $h_2$ of the countersurface 72 is for example between 20–40 cm. The above mentioned efficiency readings and measures are only advisory. The invention must not by any way be limited to them only.

I claim:

1. A biomass burner for attachment to a furnace having a combustion gas furnace opening, comprising a separate burner housing having a tubular combustion gas discharge connected to the furnace opening, wall means defining an ash pit below said furnace opening, a combustion chamber over said ash pit having a connection at one end to said combustion gas discharge and having an opposite combustion chamber end, a burnable material inlet shaft connected to said combustion chamber opposite end, said combustion chamber being a fire shaft above said ash pit having an inclined inlet surface extending inwardly and downwardly from one side toward the middle of said inlet fire shaft, said inlet surface having an upper end connected to said burnable material inlet shaft, support means extending into said fire shaft, said inlet surface having a lower end extending downwardly and inwardly of said upper end and being supported on said support means, an inclined counter surface having a lower end spaced from said inlet lower end surface so as to define together with said inlet surface an ignited material support with an air passage opening therebetween for ash and combustion air, and means for directing air through said air passage opening.

2. The burner of claim 1, wherein the burnable material inlet shaft is connected to the inclined inlet surface, the burnable material inlet shaft having a width roughly equal to the width of the fire shaft (7) and the combustion chamber (6).

3. The burner of claim 1, wherein the inclined inlet surface (71) has an angle between 15° and 45° with respect to a vertical plane B—B associated with the burner, and that the countersurface (72) has an angle between 60° and 10° with respect to the vertical plane B—B associated with the burner, the size of said angles depending on the type of fuel used.

4. The burner of claim 1, characterized in that in a space (8, 9) located below the fire shaft (7), there is installed a fan (11) or equivalent, whereby positive pressure is created in this space with respect to the combustion chamber (6).

5. The apparatus of claim 1, wherein the inlet surface and the countersurface each have a height $h_1$ and $h_2$, respectively, the inlet surface (71), measured from the air passage opening (73) up to the burnable material inlet shaft (4), has a height $h_1$ larger than the height $h_2$ of the countersurface (72) air passage opening up to the tubular combustion gas discharge (5) or equivalent.

6. The burner of claim 1, characterized in that the inlet surface (71) and the countersurface (72) are matched with each other so that a imaginable continuation (a) of the inlet surface (71) intersects the countersurface (72).

7. A biomass burner according to claim 1, wherein said support means comprises a rotatable eccentric member for raising and lowering said inlet surface so as to permit the ash to pass through the opening.

8. A biomass burner according to claim 1, including a rotatable member disposed between the lower end of said inlet member and said counter surface for moving ash and combusted materials through said opening.

* * * * *